US010453630B2

(12) United States Patent
Domzalski et al.

(10) Patent No.: US 10,453,630 B2
(45) Date of Patent: Oct. 22, 2019

(54) SURFACE MOUNT SNAP SWITCH

(71) Applicant: CoActive Technologies, LLC, Newton, MA (US)

(72) Inventors: Frank Domzalski, Wellesley, MA (US); William Agnatovech, Hudson, MA (US)

(73) Assignee: CoActive Technologies, LLC, Newton, MA (US)

( * ) Notice: Subject to any disclaimer, the term of this patent is extended or adjusted under 35 U.S.C. 154(b) by 50 days.

(21) Appl. No.: 15/687,612

(22) Filed: Aug. 28, 2017

(65) Prior Publication Data

US 2019/0066945 A1 Feb. 28, 2019

(51) Int. Cl.

| | |
|---|---|
| ***H01H 13/26*** | (2006.01) |
| ***H01H 13/04*** | (2006.01) |
| ***H01H 13/14*** | (2006.01) |
| ***H01H 13/22*** | (2006.01) |
| ***H01H 11/00*** | (2006.01) |

(52) U.S. Cl.

CPC ..... *H01H 13/26* (2013.01); *H01H 11/00* (2013.01); *H01H 13/04* (2013.01); *H01H 13/14* (2013.01); *H01H 13/22* (2013.01)

(58) Field of Classification Search

CPC ..... H01H 13/26; H01H 11/00; H01H 13/04; H01H 13/14; H01H 13/22; H01H 1/58; H01H 5/18; H01H 2001/5894

USPC ..... 200/402, 459–461, 467, 244

See application file for complete search history.

(56) References Cited

U.S. PATENT DOCUMENTS

| | | | | |
|---|---|---|---|---|
| 2,743,331 | A | 4/1956 | Lauder et al. | |
| 3,476,898 | A | 11/1969 | Ehrenfels et al. | |
| 4,394,553 | A | 7/1983 | Feil | |
| 4,673,778 | A * | 6/1987 | Lewandowski | H01H 11/00 200/284 |
| 5,043,545 | A | 8/1991 | Yamashita et al. | |
| 5,459,295 | A * | 10/1995 | Ohta | H01H 1/58 200/244 |
| 7,196,280 | B2 * | 3/2007 | Rochon | H01H 13/36 200/406 |
| 8,440,927 | B2 * | 5/2013 | Lin | H01H 13/36 200/408 |
| 9,299,506 | B2 * | 3/2016 | Tseng | F16H 25/2015 |

* cited by examiner

*Primary Examiner* — Edwin A. Leon
(74) *Attorney, Agent, or Firm* — Fox Rothschild LLP

(57) ABSTRACT

A surface mount snap switch and method of making the same, including a housing having a plurality of channels formed therein and a cover configured for snap-fit engagement with the housing. The snap switch also includes an actuator slidably disposed at least partially within the housing, a first terminal having an external surface mount portion and another portion press-fittingly held within one of the plurality of channels of the housing, and a second terminal having an external surface mount portion and another portion press-fittingly held within another one of the plurality of channels of the housing. The snap switch further includes a blade contact having a first end portion pivotally associated with the first terminal and a second end portion comprising a blade contact button, and the actuator is configured to interact with the blade contact to electrically couple the first terminal and the second terminal.

13 Claims, 5 Drawing Sheets

SURFACE MOUNT SNAP SWITCH

BACKGROUND

This patent document relates to an electrical switch, and, more specifically, to a surface mount snap switch for use in a variety of products and/or applications, such as vehicles, appliances, etc.

Miniature snap switches, or "microswitches", are known for selectively establishing an electrically-conductive path between two conductive fixed terminal contacts. A horizontally-or vertically-split housing supports an actuator which, via a lever, roller, or similar actuation mechanism, acts to deflect a tensioned blade contact having one or more contact buttons. Deflection of the blade contact in one direction may establish a conductive path between the two fixed terminal contacts, while deflection in the opposite direction may interrupt the conductive path. Accordingly, the snap switch may be of a normally-open (NO) type or a normally-closed (NC) type.

Conventional high life-cycle snap switches are prevalent in many industries and applications, but have generally been limited in construction to those having insert-molded, screw machine terminal contacts formed within one half of a horizontally split housing, with each half of the housing being formed of a thermoset plastic. While effective, such a snap switch construction leads to increased costs, as well as limited mounting configurations due to the screw machine terminal contacts.

SUMMARY

A surface mount snap switch in accordance with this patent document is described in detail below.

In accordance with one aspect of this patent document, a surface mount snap switch is disclosed, the surface mount snap switch including a housing, wherein the housing comprises a plurality of channels formed therein, each of the plurality of channels sized to accommodate a terminal therein. The snap switch also includes a cover, wherein the cover is configured for snap-fit engagement with the housing, as well as an actuator slidably disposed at least partially within the housing. The snap switch includes a first terminal having a first portion held within one of the plurality of channels of the housing and a second portion extending external to the housing, wherein the second portion of the first terminal comprises a terminal leg portion and a surface mount portion, the surface mount portion of the first terminal extending perpendicularly to the terminal leg portion of the first terminal, as well as a second terminal having a first portion held within another one of the plurality of channels of the housing and a second portion extending external to the housing, wherein the second portion of the second terminal comprises a terminal leg portion and a surface mount portion, the surface mount portion of the second terminal extending perpendicularly to the terminal leg portion of the second terminal, and further wherein the second terminal comprises a terminal contact button positioned proximate to an end opposite the surface mount portion of the second terminal. The snap switch further includes a blade contact having a first end portion pivotally associated with the first terminal and a second end portion comprising a blade contact button, wherein the actuator is configured to interact with the blade contact so as to deflect the blade contact when the actuator is slid inwardly toward the blade contact, and further wherein the deflection of the blade contact causes the blade contact button to impact the terminal contact button to electrically couple the first terminal and the second terminal.

In accordance with another aspect of this patent document, a surface mount snap switch assembly is disclosed. The surface mount snap switch assembly includes a housing formed of a thermoplastic material, the housing comprising a plurality of connection lugs, as well as a cover formed of a thermoplastic material, the cover comprising a plurality of cantilever arms, wherein each of the plurality of cantilever arms is configured for snap-fit engagement with a respective one of the plurality of connection lugs formed on the housing. The assembly also includes an actuator slidably disposed at least partially within the housing. Also included is a first terminal, the first terminal having a first portion press-fittingly engaged within a first channel formed within the housing and a second portion extending external to the housing, as well as a second terminal, the second terminal having a first portion press-fittingly engaged within a second channel formed within the housing and a second portion extending external to the housing. The snap switch assembly further includes a blade contact, the blade contact having a first end portion pivotally associated with the first terminal, a biased tongue extending therefrom, and a second end portion comprising a blade contact button.

In accordance with another aspect of this patent document, a method of making a surface mount snap switch is disclosed. The method includes forming a housing having a plurality of connection lugs formed on one or more peripheral surfaces thereof and a plurality of channels formed therein, as well as forming a cover having a plurality of cantilever arms extending from one or more peripheral surfaces thereof, wherein each of the plurality of cantilever arms is configured for snap-fit engagement with a respective one of the plurality of connection lugs formed on the housing. The method also includes positioning a slidable actuator at least partially within at least one of the plurality of channels formed within the housing, providing a first terminal, wherein the first terminal is formed of a stamped conductive material, and press-fittingly engaging a portion of the first terminal within one of the plurality of channels formed within the housing. The method also includes providing a second terminal, wherein the second terminal is formed of a stamped conductive material, and press-fittingly engaging a portion of the second terminal within the housing within another one of the plurality of channels formed within the housing. Additionally, the method includes providing a pivot contact coupled to the first terminal, providing a blade contact having a biased tongue extending therefrom, pivotally associating a first end of the blade contact with a first portion of the pivot contact and associating an end of the biased tongue with a second portion of the pivot contact, and coupling the slidable actuator to the blade contact.

BRIEF DESCRIPTION OF THE DRAWINGS

Other characteristics and advantages of the embodiments above will be made clear by the following detailed description, the comprehension of which will be facilitated by reference to the attached figures, of which.

FIG. lA is a front perspective view of a surface mount snap switch according to some embodiments.

DETAILED DESCRIPTION

The following description is made for the purpose of illustrating the general principles of the present disclosure and is not meant to limit the inventive concepts claimed in this document. Further, particular features described in this document can be used in combination with other described features in each of the various possible combinations and permutations.

Unless otherwise specifically defined in this document, all terms are to be given their broadest possible interpretation including meanings implied from the specification as well as meanings understood by those skilled in the art and/or as defined in dictionaries, treatises, etc.

It must also be noted that, as used in the specification and the appended claims, the singular forms "a," "an" and "the" include plural references unless otherwise specified.

In this document, position-identifying terms such as "vertical" and "horizontal" are not intended to limit the invention to a particular direction, but instead are only intended to denote relative positions, or positions corresponding to directions shown when a switch is oriented as shown in the Figures.

Figure 1A:
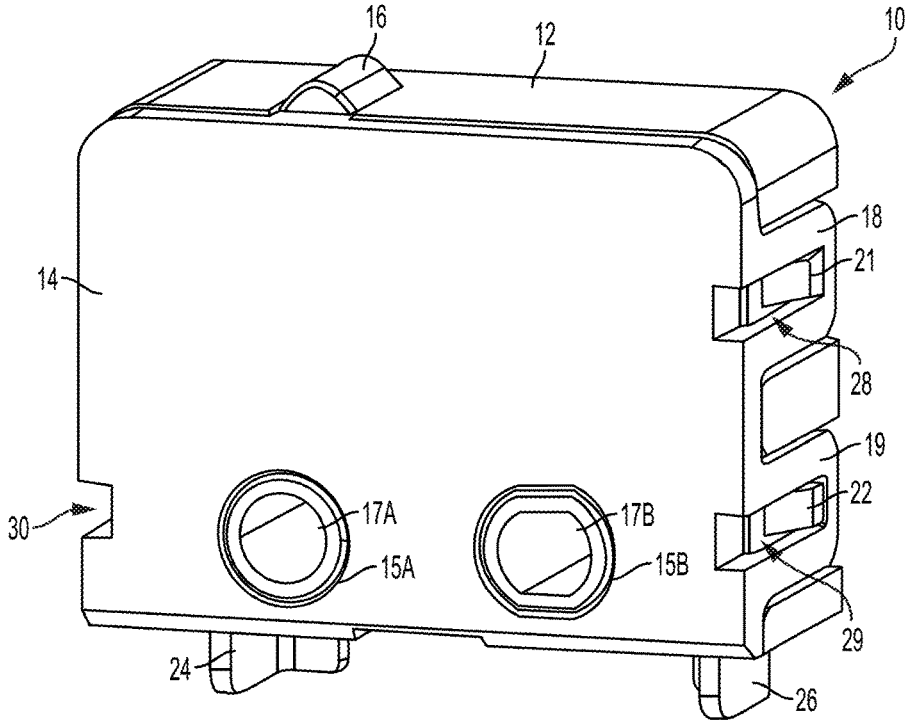
FIG. 1B another front perspective view of the surface mount snap switch of FIG. 1A.
Figure 1B:
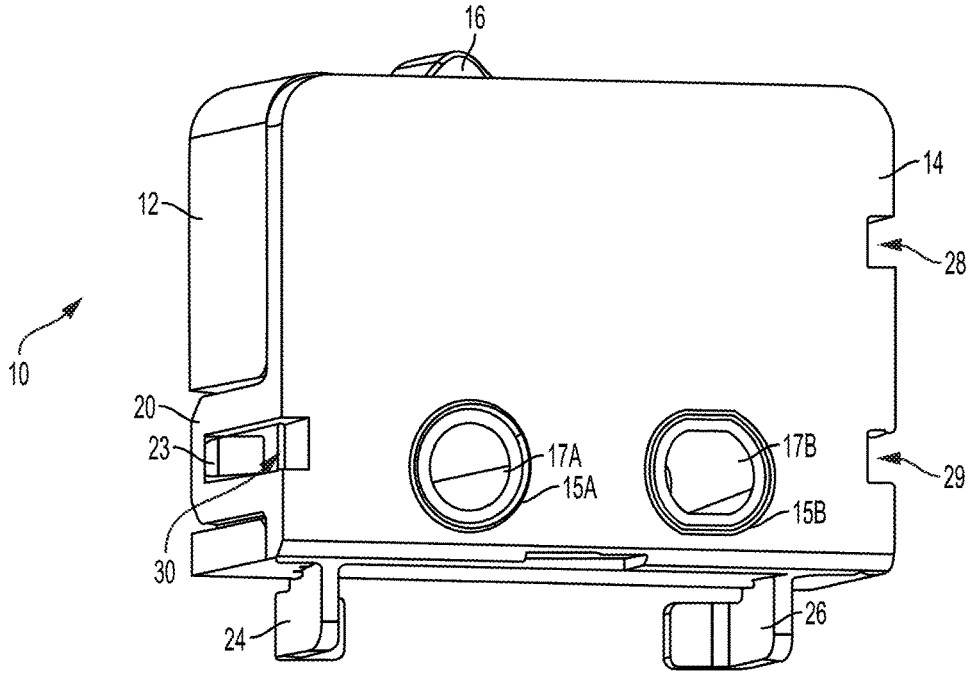

Referring to FIGS. 1A-1B, a surface mount snap switch 10 in accordance with aspects of the present disclosure is illustrated. Snap switch 10 comprises a housing 12 and a cover 14, with cover 14 configured to be coupled to housing 12 via one or more snap-fit interfaces. For example, as shown in FIGS. 1A-1B, cover 14 may comprise flexible cantilever arms 18, 19, 20, while housing 12 may comprise corresponding lugs 21, 22, 23. Each of cantilever arms 18, 19, 20 may include a respective arm slot 28, 29, 30 sized to accommodate the width and depth of lugs 21, 22, 23. During assembly of snap switch 10, cover 14 may be slid onto housing 12, with cantilever arms 18, 19, 20 configured to flex outwardly as they slide along forward-facing angled surfaces of respective lugs 21, 22, 23. When cover 14 is fully slid/pressed onto housing 12, the distal ends of cantilever arms 18, 19, 20 will extend beyond lugs 21, 22, 23, with arm slots 28, 29, 30 allowing cantilever arms 18, 19, 20 to retract inwardly, thereby forming a substantially tight snap-fit engagement between cover 14 and housing 12 without the need for costly and time-consuming coupling methods such as ultrasonic welding. Conversely, when assembled, the cantilever arms 18, 19, 20 may be manually flexed outwardly so as to release the coupling between cantilever arms 18, 19, 20 and lugs 21, 22, 23, thereby allowing for access into the interior of housing 12, even after snap switch 10 is initially assembled.

Formed through housing 12 is a pair of longitudinally-spaced, laterally-aligned mounting openings 17A, 17B, with each of mounting openings 17A, 17B adapted to receive mounting hardware (e.g., screws, bolts, etc.) therethrough. Cover 14 includes corresponding openings 15A, 15B formed therethrough.

Both housing 12 and cover 14 may be formed of a thermoplastic material, such as, e.g., polycarbonate, polyethylene, polypropylene, etc., and housing 12 and cover 14 may be formed of the same or different types of thermoplastics, respectively. Additionally, both housing 12 and cover 14 may be formed using an injection molding process, thereby enabling precise cavities, projections, etc. to be formed within or upon housing 12 and cover 14. As one or more thermoplastics are utilized, at least some portion of housing 12 and/or cover 14 may be flexible so as to allow for a snap-fit engagement between the two components.

While FIGS. 1A-1B show cover 14 having three cantilever arms 18, 19, 20 configured to interact with three corresponding lugs 21, 22, 23 of housing 12, it is to be understood that more or fewer cantilever arms and/or lugs may be used in forming the snap-fit configuration of snap switch 10. Furthermore, additional or alternative coupling features may be present on one or both of housing 12 and cover 14.

Figure 2:
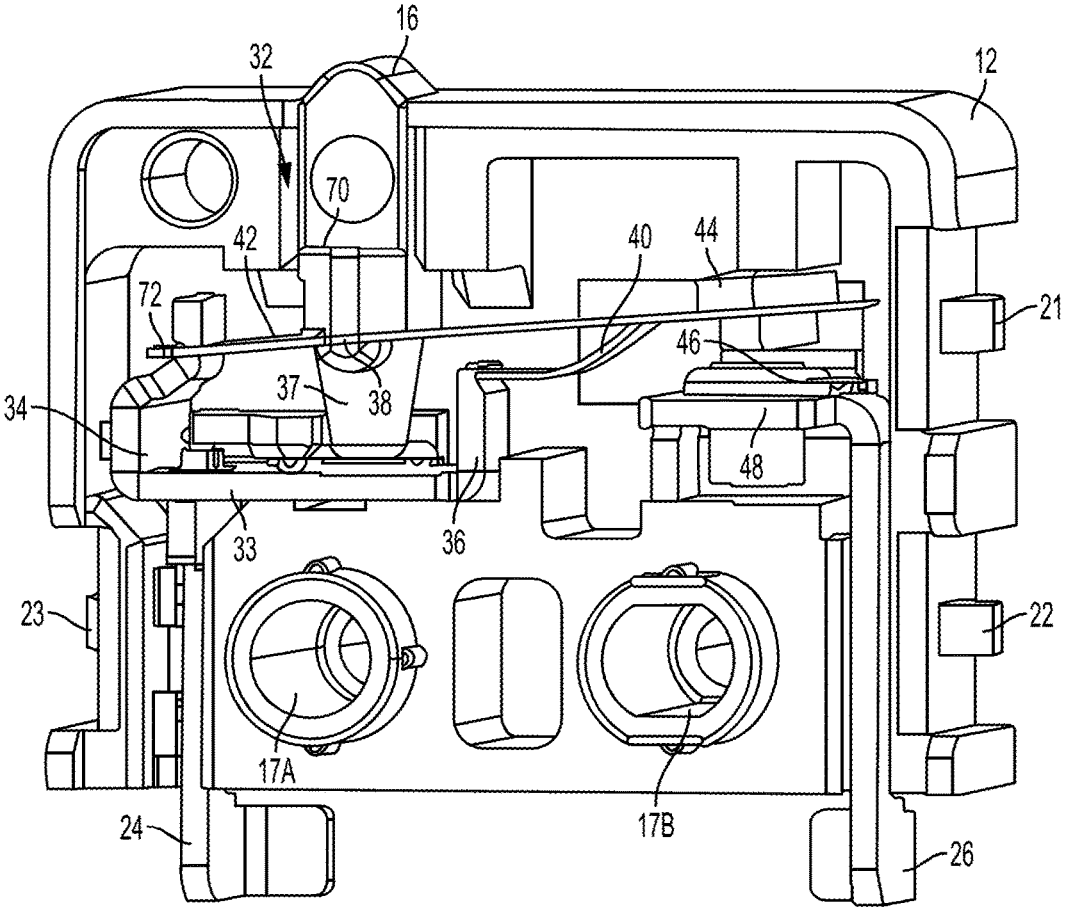
FIG. 2 is a partial internal view of select components of the surface mount snap switch of FIGS. 1A-1B.

Referring now to FIGS. 2-5, additional components of snap switch 10 are shown and described, particularly select interior components of snap switch 10. Specifically, as shown in FIG. 2, a pair of terminals 24, 26 are partially retained within housing 12, with respective distal ends of terminals 24, 26 protruding from housing 12 so as to be connectable to external conductors (not shown). While only two terminals 24, 26 are shown in FIGS. 2-5, it is to be understood that at least one additional terminal may be incorporated into housing 12. As will be described further herein, terminal 24 is configured as a common terminal, while terminal 26 may be configured as a normally-closed (NC) terminal. However, while not shown in FIGS. 2-5, it is to be understood that at least an additional, normally-open (NO) terminal may also be incorporated into the snap switch.

Terminals 24, 26 are formed of an electrically-conductive material, such as copper alloy, aluminum alloy, or the like. Unlike many conventional snap switches, which often utilize insert molded screw machine terminals, terminals 24, 26 may be formed by a stamping process, which allows for greater customization in terminal shape, size, and mounting configurations, while also reducing costs associated with component construction.

Figure 3:
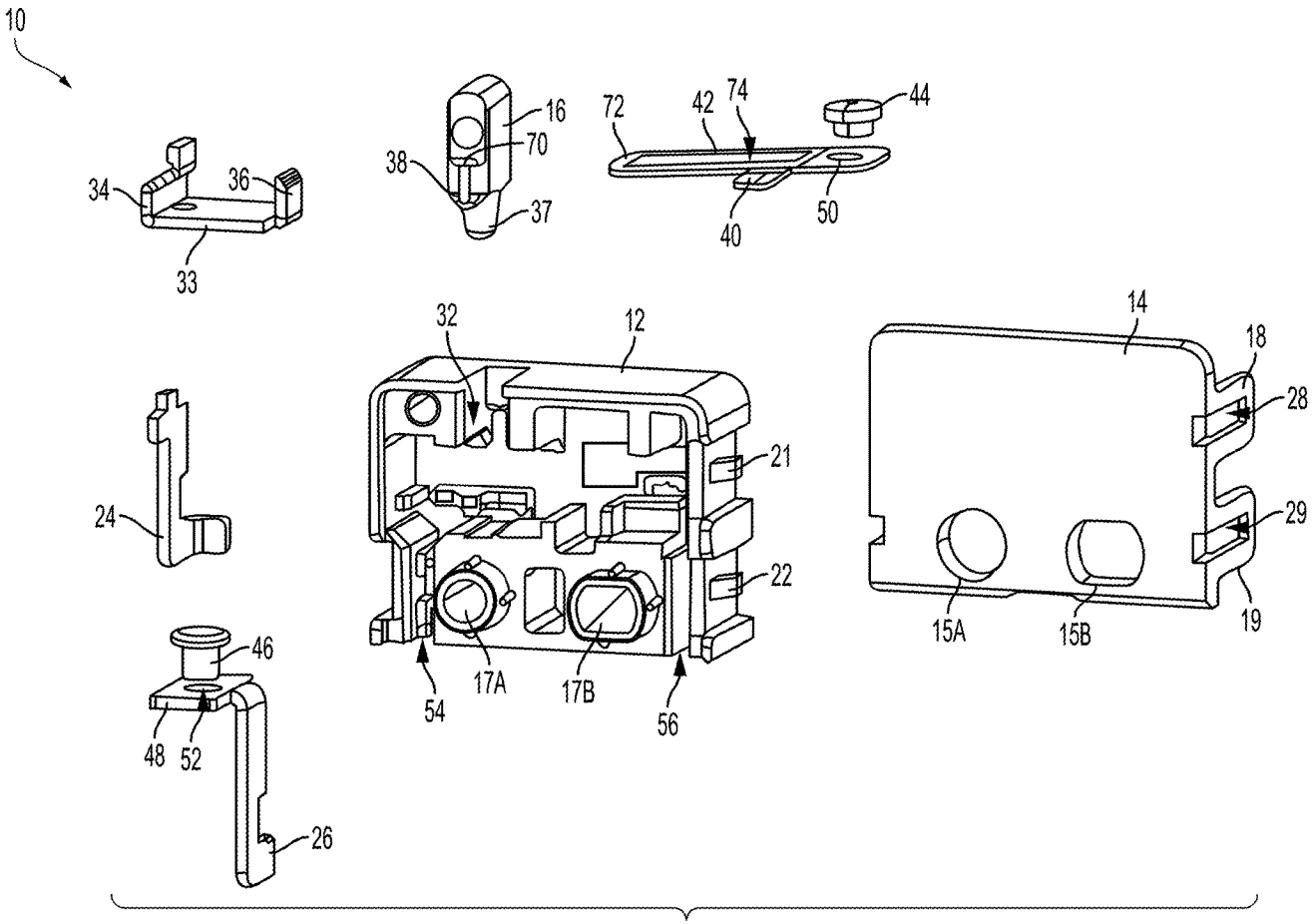
FIG. 3 is an exploded view of the components of the surface mount snap switch of FIGS. 1A-1B.
Figure 5:
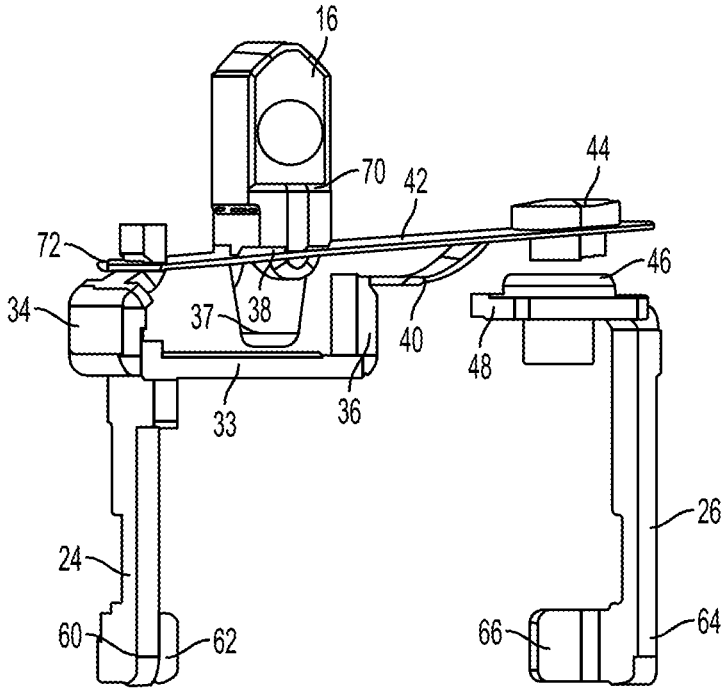
FIG. 5 is a perspective view of select internal components of the surface mount snap switch of FIGS. 1A-1B.

Referring to FIGS. 2, 3, and 5, terminal 24 is coupled at a proximal end to a pivot contact 33, with pivot contact 33 having a pair of vertically-extending legs 34, 36. While shown in FIG. 3 as being formed separately from terminal 24, it is to be understood that pivot contact 33 may instead be formed integrally with terminal 24. Coupled to leg 34 of pivot contact 33 is a pivot end 72 of an elongated, conductive blade contact 42, while a biased tongue 40 extending from blade contact 42 contacts and rests upon a surface of leg 36 of pivot contact 33. A contact button 44 extends through a hole 50 formed in blade contact 42, opposite pivot end 72.

Terminal 26, located opposite terminal 24 within housing 12, is formed with a laterally-extending portion 48 projecting substantially perpendicularly from the vertical portion of terminal 26, with laterally-extending portion 48 having a hole 52 formed therethrough so as to accommodate a contact button 46 fixedly disposed therein. Both contact button 44 on blade contact 42 and contact button 46 on terminal 26 may be formed of a highly-conductive material, such as copper, silver, etc.

Within an opening 32 formed in housing 12, an actuator 16 is slidably disposed so as to selectively interact with blade contact 42 during operation of the snap switch 10. Actuator 16 is generally formed of a non-conductive material, and may be configured to interact externally with any applicable and appropriate secondary actuator located external to the snap switch 10, such as a lever (not shown) pivotable about a surface of the housing 12, a plunger (not shown), a roller (not shown), etc. Internal to housing 12, actuator 16 comprises a distal end 37, which may limit "inward" travel of actuator 16 into housing 12, while an upper shoulder 70 formed on at least one surface of actuator 16 may limit the "outward" travel of actuator 16 from housing 12 through interaction with a corresponding and opposing shoulder or surface (not shown) within opening 32 on housing 12 and/or cover 14.

When assembled, actuator 16 partially extends through an opening 74 formed in blade contact 42, but is also coupled to a portion of blade contact 42 at a connection location 38 formed on or within actuator 16. Connection site 38 may be formed as a shoulder, a slot, or any other appropriate configuration which allows for at least partial coupling of actuator 16 with blade contact 42 such that blade contact 42 may at least partially deflect with movement of actuator 16.

As shown in FIG. 2, in a static, inactivated operational condition, blade contact 42 is held upward by preloaded, biased tongue 40 such that contact button 44 on blade contact 42 and contact button 46 on terminal 26 do not touch. However, as actuator 16 is depressed, blade contact 42 is flexed, with the upward force provided by biased tongue 40 eventually being overcome by the downward force imparted by actuator 16. The upward force provided by biased tongue 40 is reduced as actuator 16 is further depressed to the point that contact button 44 on blade contact 42 accelerates toward and impacts contact button 46 on terminal 26, thereby electrically coupling terminals 24 and 26. Such high-speed impact between contact button 44 and contact button 46 provides for the distinctive "snap" of snap switch 10.

Conversely, as depression of actuator 16 is relieved, the upward force provided by biased tongue 40 moves contact button 44 away from contact button 46, with blade contact 42 accelerating upward until contact button 44 contacts an interior surface within housing 12 (as shown in FIG. 2) or a normally-open terminal (not shown), thereby electrically decoupling terminals 24 and 26.

Figure 4A:
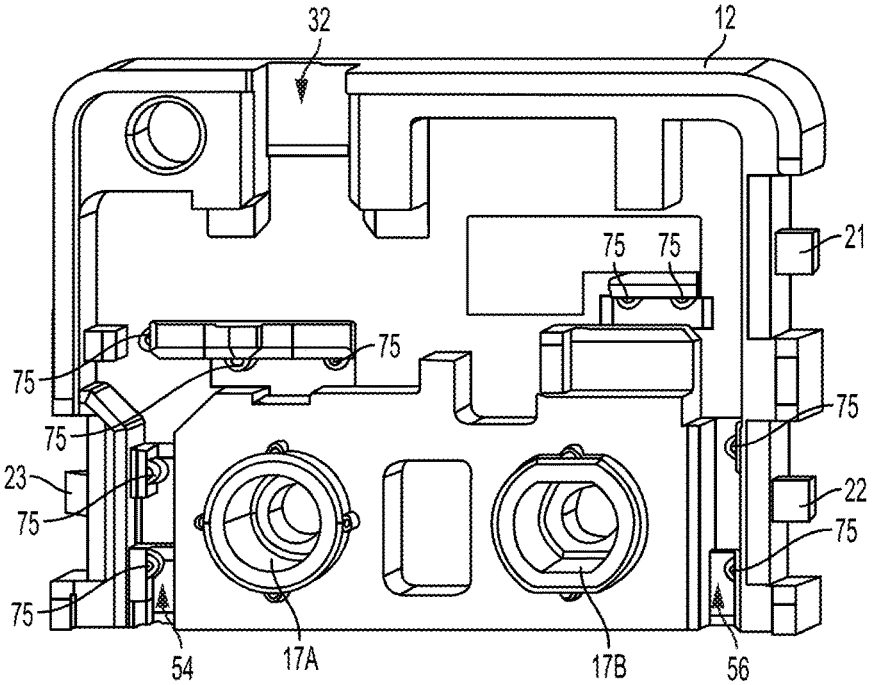
FIG. 4A is a perspective internal view of a body portion of the surface mount snap switch of FIGS. 1A-1B.
Figure 4B:
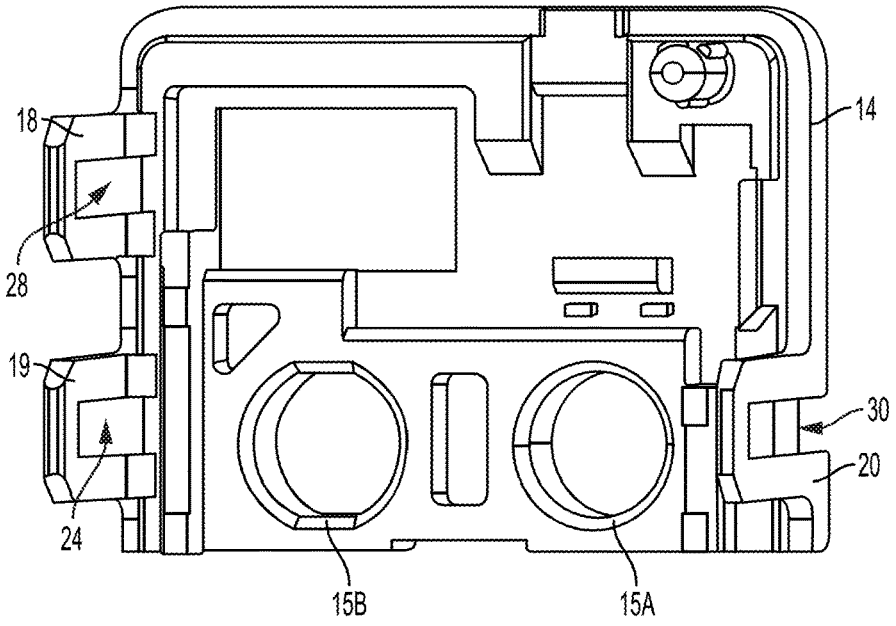
FIG. 4B is a perspective internal view of a cover portion of the surface mount snap switch of FIGS. 1A-1B.

Referring now to FIGS. 4A-4B, details of the interior surfaces of both housing 12 and cover 14 are illustrated. As shown in FIG. 4A, housing 12 includes a pair of terminal channels 54, 56, which respectively allow for terminals 24, 26 to be press-fit therein. Again, snap switch 10 is not limited to only two terminals. Accordingly, one or more additional terminal channels may be formed in housing 12 so as to accommodate one or more additional terminals.

FIG. 4A also shows that a plurality of terminal supports 75 are disposed within terminal channels 54, 56, as well as at other locations within housing 12. Terminal supports 75 may be configured to provide frictional and/or clasping support to terminals 24, 26 and pivot contact 33 so as to allow the components to be press-fit into housing 12 during the manufacturing process of snap switch 10, with cover 14 being coupled to housing 12 after the press-fit insertion of these interior components. It is to be understood that more or fewer terminal supports 75 than what is shown in FIG. 4A may be utilized within housing 12. Such a configuration allows for a simplified, low-cost assembly of the snap switch, while still maintaining an appropriate level of support for the conductive components that the switch contains.

As noted above, both housing 12 and cover 14 may be formed one or more thermoplastic materials, which enables the components to be formed precisely (via, for example, injection molding) and relatively inexpensively. In addition, the utilization of thermoplastic materials may also allow for one or both of housing 12 and cover 14 to be flexible so as to enable the snap-fit connection therebetween. This vertically-separated, snap-fit connection differs from conventional snap switch designs, which generally utilize horizontally-stacked thermoset materials to form the body of the snap switch, which increases the labor and costs associated with forming and assembling the snap switch.

Referring to FIG. 5, further details of the internal components of a snap switch, and particularly terminals 24, 26, are shown. As described above, terminals 24, 26 are preferably formed via a stamping process, which allows for terminals 24, 26 to be uniquely shaped dependent upon the desired application and/or location of the snap switch. For example, as shown in FIG. 5, terminal 24 includes a terminal leg portion 60, along with a surface mount portion 62 extending substantially perpendicularly therefrom. Similarly, terminal 26 includes a terminal leg portion 64 and a surface mount portion 66 extending perpendicularly therefrom. With such a configuration, terminals 24, 26 may be mounted or placed directly onto the pads of a printed circuit board (PCB), allowing the snap switch to be a surface mount device. Such a configuration differs greatly from conventional miniature snap switches, which generally required screw machine terminals that involved more complex and costly installation, as well as increased footprint. By configuring terminals 24, 26 as surface mount terminals, the size, cost, and complexity of incorporating the snap switch into a particular application may be greatly reduced.

However, even with such improvements in size, cost, and complexity, the snap switch may still provide a suitable power rating and life cycle for many applications. For example, the snap switch according to the embodiments of this document may have a minimum life of 100,000 cycles, and it may be rated up to 7 A at 250 VAC, with a 40 A inrush for 0.7 ms. It is to be noted that the above power rating and life cycle are merely examples, and the snap switch in accordance with aspects of this patent document is not limited as such.

In accordance with another aspect of this patent document, a method of making a surface mount snap switch is disclosed. The method includes forming a housing having a plurality of connection lugs formed on one or more peripheral surfaces thereof and a plurality of channels formed therein, as well as forming a cover having a plurality of cantilever arms extending from one or more peripheral surfaces thereof, wherein each of the plurality of cantilever arms is configured for snap-fit engagement with a respective one of the plurality of connection lugs formed on the housing.

The method of making the surface mount snap switch also includes positioning a slidable actuator at least partially within at least one of the plurality of channels formed within the housing, providing a first terminal, wherein the first terminal is formed of a stamped conductive material, and press-fittingly engaging a portion of the first terminal within one of the plurality of channels formed within the housing. The method also includes providing a second terminal, wherein the second terminal is formed of a stamped conductive material, and press-fittingly engaging a portion of the second terminal within the housing within another one of the plurality of channels formed within the housing.

Additionally, the method includes providing a pivot contact coupled to the first terminal, providing a blade contact having a biased tongue extending therefrom, pivotally associating a first end of the blade contact with a first portion of the pivot contact and associating an end of the biased tongue with a second portion of the pivot contact, and coupling the slidable actuator to the blade contact.

In accordance with the method described above, the step of forming the housing may further include forming a plurality of terminal supports within one or more of the plurality of channels for press-fit engagement of the first terminal and the second terminal.

The step of forming the housing may also include forming the housing of an injection-molded thermoplastic material, and the step of forming the cover may include forming the cover of an injection-molded thermoplastic material.

Additionally, the method may include forming the first terminal to have a surface mount portion on one end of the first terminal, and forming the second terminal to have a surface mount portion on one end of the second terminal.

Other advantages of the present disclosure can be apparent to those skilled in the art from the foregoing specification. Accordingly, it will be recognized by those skilled in the art that changes or modifications may be made to the above-described embodiments without departing from the broad inventive concepts of the disclosure. It should therefore be understood that this disclosure is not limited to the particular embodiments described herein, but is intended to include all changes and modifications that are within the scope and spirit of the disclosure as defined in the claims.

The invention claimed is:

1. A surface mount snap switch comprising:

a housing, wherein the housing comprises a plurality of channels formed therein, each of the plurality of channels sized to accommodate a terminal therein;

a cover, wherein the cover is configured for snap-fit engagement with the housing;

an actuator slidably disposed at least partially within the housing;

a first terminal, the first terminal having a first portion held within one of the channels of the housing and a second portion extending external to the housing, wherein the second portion of the first terminal comprises a terminal leg portion and a surface mount portion, the surface mount portion of the first terminal extending perpendicularly to the terminal leg portion of the first terminal;

a second terminal, the second terminal having a first portion held within another one of the channels of the housing and a second portion extending external to the housing, wherein the second portion of the second terminal also comprises a terminal leg portion and a surface mount portion, the surface mount portion extending perpendicularly to the terminal leg portion of the second terminal, and further wherein the second terminal comprises a terminal contact button positioned proximate to an end opposite the surface mount portion of the second terminal;

a blade contact, the blade contact having a first end portion pivotally associated with the first terminal and a second end portion comprising a blade contact button;

a biased tongue extending from the blade contact, wherein the biased tongue is configured to provide a biasing force on the blade contact; and a pivot contact coupled to the first terminal, the pivot contact having a first leg portion and a second leg portion, the first leg portion configured to support the first end portion of the blade contact and the second leg portion configured to support an end of the biased tongue, wherein the actuator is configured to interact with the blade contact so as to deflect the blade contact when the actuator is slid inwardly toward the blade contact, and further wherein the deflection of the blade contact causes the blade contact button to impact the terminal contact button to electrically couple the first terminal and the second terminal.

2. The snap switch of claim 1, further comprising a plurality of cantilever arms on the cover and a corresponding plurality of lugs on the housing, wherein each of the plurality of cantilever arms comprises an opening therethrough, the opening sized and configured to accept a corresponding lug on the housing to form a snap-fit connection between the cover and the housing.

3. The snap switch of claim 2, wherein the plurality of cantilever arms are flexible.

4. The snap switch of claim 1, wherein both the housing and the cover are formed of at least one thermoplastic material.

5. The snap switch of claim 1, wherein, when the cover is removed from the housing, at least one face of the housing is open to allow access to the plurality of channels.

6. The snap switch of claim 1, wherein the actuator further comprises a connection location formed thereon for coupling the actuator to the blade contact.

7. The snap switch of claim 6, wherein the connection location is one of at least one shoulder and at least one slot.

8. The snap switch of claim 6, wherein the actuator further comprises at least one upper shoulder, the at least one upper shoulder configured to interact with at least one surface on the housing to limit outward travel of the actuator.

9. The snap switch of claim 1, further comprising a plurality of terminal supports formed in the plurality of channels of the housing, the plurality of terminal supports configured to enable press-fitting engagement of a terminal within each of the plurality of channels.

10. The snap switch of claim 1, wherein the first terminal and the second terminal are formed of a stamped conductive material.

11. A surface mount snap switch assembly comprising:

a housing formed of a thermoplastic material, the housing comprising a plurality of connection lugs;

a cover formed of a thermoplastic material, the cover comprising a plurality of cantilever arms, wherein each of the plurality of cantilever arms is configured for snap-fit engagement with a respective one of the plurality of connection lugs formed on the housing;

an actuator slidably disposed at least partially within the housing;

a first terminal, the first terminal having a first portion press-fittingly engaged within a first channel formed within the housing and a second portion extending external to the housing;

a second terminal, the second terminal having a first portion press-fittingly engaged within a second channel formed within the housing and a second portion extending external to the housing;

a blade contact, the blade contact having a first end portion pivotally associated with the first terminal, a biased tongue extending therefrom, and a second end portion comprising a blade contact button; and a pivot contact coupled to the first terminal, the pivot contact having a first leg portion and a second leg portion, the first leg portion configured to support the first end portion of the blade contact and the second leg portion configured to support an end of the biased tongue.

12. The snap switch assembly of claim 11, wherein the second portion of the first terminal comprises a terminal leg portion and a surface mount portion, the surface mount portion of the first terminal extending perpendicularly to the terminal leg portion of the first terminal, and further wherein the second portion of the second terminal comprises a terminal leg portion and a surface mount portion, the surface mount portion of the second terminal extending perpendicularly to the terminal leg portion of the second terminal, and further wherein the second terminal comprises a terminal contact button coupled thereto at an end opposite the surface mount portion.

13. The snap switch assembly of claim 11, further comprising a plurality of terminal supports formed within the housing, wherein one or more of the plurality of terminal supports are configured to enable press-fitting engagement of the first portion of the first terminal within the housing, and another one or more of the plurality of terminal supports are configured to enable press-fitting engagement of the first portion of the second terminal within the housing.

* * * * *